US008602162B2

(12) United States Patent
Dondurur et al.

(10) Patent No.: US 8,602,162 B2
(45) Date of Patent: Dec. 10, 2013

(54) SAFETY LADDER

(75) Inventors: Mehmet Dondurur, Dhahran (SA); Ahmet Z. Sahin, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 140 days.

(21) Appl. No.: 13/089,032

(22) Filed: Apr. 18, 2011

(65) Prior Publication Data

US 2012/0261214 A1 Oct. 18, 2012

(51) Int. Cl.

| | |
|---|---|
| ***E06C 7/42*** | (2006.01) |
| ***E06C 7/18*** | (2006.01) |
| ***E06C 7/10*** | (2006.01) |

(52) U.S. Cl.

USPC ..... 182/107; 182/106; 182/172

(58) Field of Classification Search

USPC ..... 182/107, 172, 106

See application file for complete search history.

(56) References Cited

U.S. PATENT DOCUMENTS

| | | | | | |
|---|---|---|---|---|---|
| 783,259 | A | * | 2/1905 | Friend | 182/107 |
| 840,365 | A | | 1/1907 | Pease | |
| 1,352,323 | A | * | 9/1920 | Stephan | 182/109 |
| 1,541,402 | A | | 6/1925 | Seaman | |
| 1,676,618 | A | | 7/1928 | Morris | |
| 2,551,345 | A | * | 5/1951 | Scott | 52/183 |
| 2,887,260 | A | * | 5/1959 | McKinnie | 182/168 |
| 2,944,625 | A | * | 7/1960 | Shore et al. | 182/106 |
| 3,012,628 | A | | 12/1961 | Zumbaum | |
| 3,025,926 | A | | 3/1962 | Vives | |
| 3,072,218 | A | * | 1/1963 | Peters | 182/214 |
| 3,618,703 | A | | 11/1971 | Wilke | |
| 3,891,054 | A | | 6/1975 | Larson | |
| 4,039,047 | A | * | 8/1977 | Larson et al. | 182/111 |
| 4,147,231 | A | | 4/1979 | Chantler et al. | |
| 4,306,632 | A | | 12/1981 | Brown | |
| 4,899,849 | A | | 2/1990 | Levi et al. | |
| 4,964,488 | A | * | 10/1990 | Stewart | 182/172 |
| 5,551,529 | A | | 9/1996 | Molitor | |
| 5,918,698 | A | * | 7/1999 | Lunn | 182/107 |
| 5,931,259 | A | | 8/1999 | Hoey | |
| 6,089,350 | A | * | 7/2000 | Hankins | 182/107 |
| 7,789,199 | B2 | * | 9/2010 | Wollenberg et al. | 182/214 |
| 7,992,681 | B2 | * | 8/2011 | Anderson et al. | 182/106 |
| 2004/0055820 | A1 | * | 3/2004 | Charlton | 182/107 |
| 2006/0124394 | A1 | * | 6/2006 | Bracken et al. | 182/107 |
| 2010/0230208 | A1 | * | 9/2010 | Hsiao et al. | 182/106 |
| 2011/0067954 | A1 | * | 3/2011 | Deal | 182/107 |

FOREIGN PATENT DOCUMENTS

| | | | |
|---|---|---|---|
| DE | 3941121 | A1 * | 6/1990 |

* cited by examiner

*Primary Examiner* — Alvin Chin Shue
(74) *Attorney, Agent, or Firm* — Richard C. Litman

(57) ABSTRACT

The safety ladder may be an extension ladder having two or more relatively sliding sections, and incorporates a number of safety devices. The lower end of the ladder incorporates two opposed lateral stabilizers and two outwardly extending stabilizers, i.e., extending from the opposite face of the ladder from the structure against which the ladder is placed. The upper end of the ladder includes a pair of articulating lateral arms that brace against the structure against which the ladder is deployed, and articulating clamps or straps for securing the ladder to the structure. The medial portion of the ladder includes a handrail extending from each ladder rail. All of these devices may be retracted, collapsed, and/or folded for compact storage and transport when not in use. The entire ladder, i.e., rails, rungs, as well as the various safety components attached thereto, is coated with an electrically non-conductive coating for additional safety.

11 Claims, 11 Drawing Sheets

12b
26
16
22b
24
40
42
32
38
34
20b
30
36b
28
44
50
50
48
48
48
48

SAFETY LADDER

BACKGROUND OF THE INVENTION

1. Field of the Invention

The present invention relates generally to ladders, and particularly to a safety ladder that provides an extension ladder incorporating numerous safety features, which provide greater stability for the ladder and safety for its user.

2. Description of the Related Art

Ladders of various types and configurations have been known for a considerable period of time. Ladders in general may be divided into two different types, i.e., the freestanding stepladder and the plain ladder that requires some other structure for support. The plain ladder includes ladders of unitary structure and extension ladders having one or more sections that slide or telescope relative to one another, the sections extending to provide greater length or retracting for compact storage.

One problem common to all ladders is their inherent instability as a result of their generally relatively narrow base, the elevation of the top of the ladder, and the load (generally a worker) on the ladder, particularly near the top of the ladder. Even in the case of taller extension ladders with the upper end of the ladder resting upon some supporting structure, the relatively narrow base may not provide the required stability when placed upon a soft or uneven surface, as the upper portion of the ladder may slide laterally on its supporting structure (e.g., eaves of a roof, tree branch, elevated railing, etc.). While some ladders have been provided with lateral extensions at their bases to increase their widths, these extensions are generally not retractable and result in considerably greater bulk for the ladder.

Moreover, plain ladders and extension ladders have no defined slope, as do stepladders with their attached bracing and supports. In many instances a plain ladder or extension ladder must be erected at a nearly vertical angle in order to provide the required reach or to position the base upon a suitable surface. This is even more likely with taller extension ladders. The imposition of a relatively large load that is offset outwardly from the plane of the ladder, e.g., a worker climbing the ladder with his or her equipment and supplies, can result in the combined center of gravity of the worker, his or her equipment, and the ladder shifting to a point outside the base of the ladder, i.e., opposite the structure supporting the upper end of the ladder. The result is that the ladder will topple over backwards onto the worker, and possibly damage other structure in the path of the falling ladder.

Another problem common to all ladders is the difficulty in climbing the ladder, particularly when carrying various tools, supplies, and/or equipment. In many instances the worker climbing the ladder is burdened with considerable weight and bulk by the various articles he or she is carrying, with the load further reducing the stability of the worker on the ladder. Even where the ladder is erected with sufficient slope for good forward and rearward stability, the worker climbing the ladder can easily be thrown off balance laterally due to the load he or she is carrying. Yet, the conventional plain ladder or extension ladder provides nothing in the manner of lateral security or support for the worker. He or she is dependent upon whatever grip may be attained from standing on and grasping the relatively narrow rungs of the ladder.

Thus, a safety ladder solving the aforementioned problems is desired.

SUMMARY OF THE INVENTION

The safety ladder may be a plain ladder, but is preferably an extension ladder having two or more relatively sliding sections. The safety ladder incorporates a number of safety devices or features therewith. These safety devices or features may be considered relative to their locations on the ladder, i.e., at the bottom, medial area, or the top of the ladder.

The lower end or bottom of the ladder incorporates a number of stabilizing braces or legs that may be deployed outwardly from the ladder for use. Two lateral stabilizers extend outward from the rails of the ladder to provide a wider and therefore more stable width for the base of the ladder when erected. Two different configurations of lateral stabilizers are disclosed, one configuration being straight and the other configuration having some curvature. A pair of outwardly extending stabilizers may be selectively extended away from the front of the ladder, i.e., to the opposite side of the ladder from the structure against which it is placed, in order to prevent the ladder from toppling over backwards if erected at too steep an angle. All of these stabilizers may be telescoped to extend or retract as required, and to fold against the ladder frame for compact storage when not in use. Each type may incorporate a support pad at the distal end thereof or, alternatively, a plurality of retractable fingers for better support and stability.

A folding handrail is provided along each rail of the ladder, the two handrails being selectively deployed for use or folding against the front of the ladder for compact storage and transport of the ladder. Either or both handrails may be deployed independently of one another. The entire ladder, i.e., its rails and its rungs, is coated with an electrically non-conductive material, e.g., rubber or plastic, for additional safety. The folding handrails and other safety attachments disclosed herein are also preferably coated with electrically non-conductive material as well, to the extent practicable.

The upper end of the ladder may include any of a number of different safety devices. An articulating lateral stabilizer arm or standoff extends from the upper portion of each ladder rail. These standoffs or arms may be selectively oriented to provide bracing against a vertical wall or against the horizontal or sloped roof of a structure, as required. The arms may be folded against the ladder when not in use. In addition, a plurality of different clamp configurations may be provided at the upper end of the ladder. The clamps are provided in pairs, with one clamp extending from the upper end of each rail. The jaws of the clamps may form a generally U-shaped configuration, a semicircular or circular configuration when closed, or may comprise a pair of flat members hinged at their mating ends. Threaded adjusters are provided to close the jaws together about a supporting structure, e.g., the eaves of a roof, a guardrail along the upper edge of a structure, a tree branch, etc. Alternatively, flexible straps may be provided for securing about a suitable object, where appropriate.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The safety ladder includes a number of safety features therewith to provide greater safety and security for a user of the ladder. The safety features may include lower stabilizer legs or braces, upper braces and attachments, and/or lateral guardrails, in any practicable combination. The various features of the safety ladder may be incorporated with a plain ladder, i.e., a ladder having only a single section, but are particularly well suited for an extension ladder having two or more mutually telescoping sections.

Figure 1:
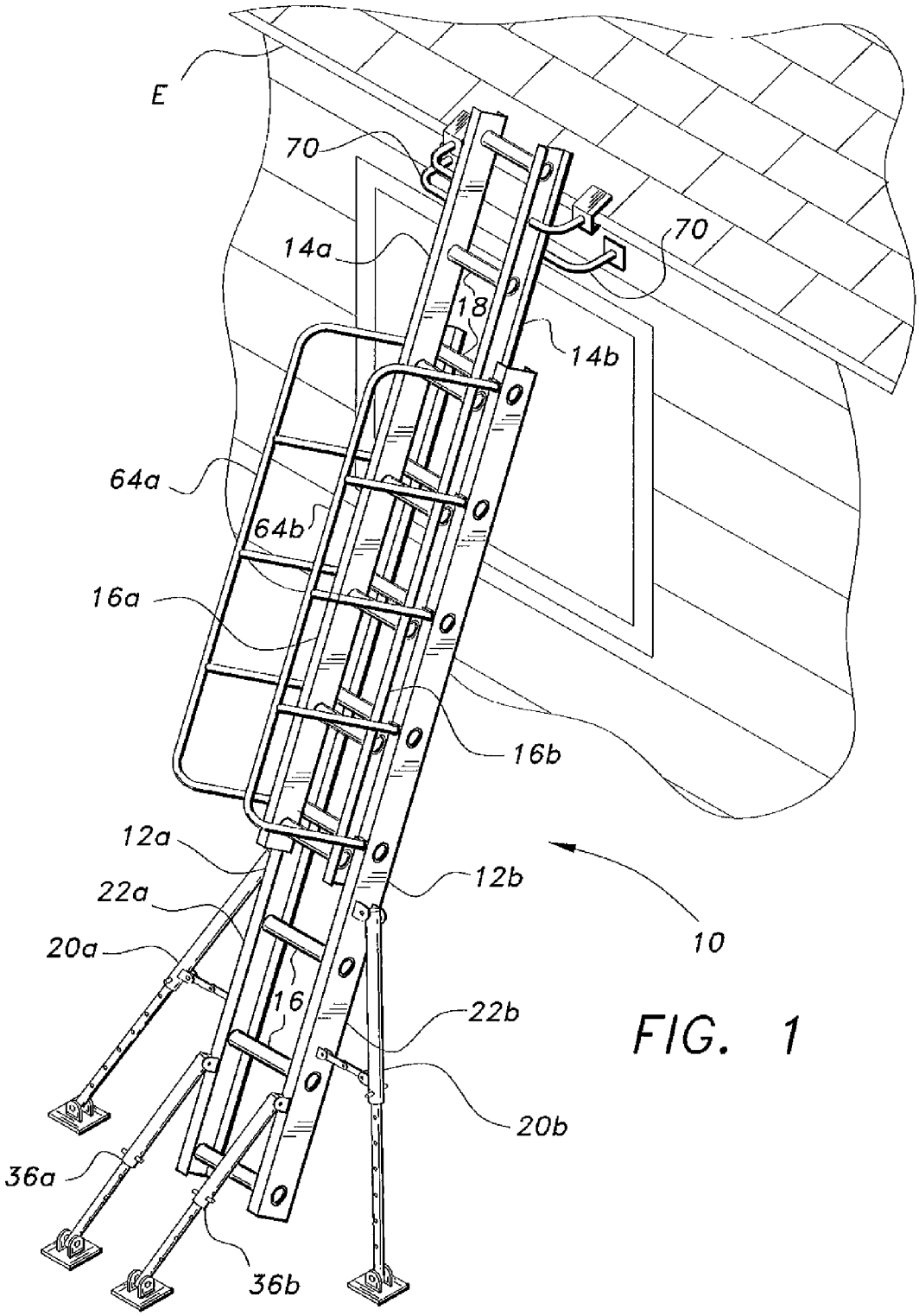
FIG. 1 is an environmental, perspective view of a safety ladder according to the present invention, illustrating a number of its features and their deployment.

FIG. 1 of the drawings illustrates a first embodiment of the safety ladder, designated as ladder 10 in the drawings. The safety ladder 10 includes mutually opposed, parallel first and second lower rail members, respectively 12*a* and 12*b*, and mutually opposed, parallel first and second upper rail members, respectively 14*a* and 14*b*. The two lower rail members 12*a*, 12*b* are spaced apart and connected to one another by a plurality of spaced apart rungs 16, the two upper rail members 14*a*, 14*b* being spaced apart and connected to one another by a similar set of rungs 18. The lower rail members 12*a*, 12*b* and their rungs 16 define a lower ladder plane, and the upper rail members 14*a*, 14*b* and their rungs 18 define an upper ladder plane parallel to the lower ladder plane. The upper ladder assembly, comprising the two upper rail members 14*a*, 14*b* and their rungs 18, telescopes or slides relative to the lower ladder assembly to allow the safety ladder 10 to be selectively extended or retracted in length.

Figure 2:
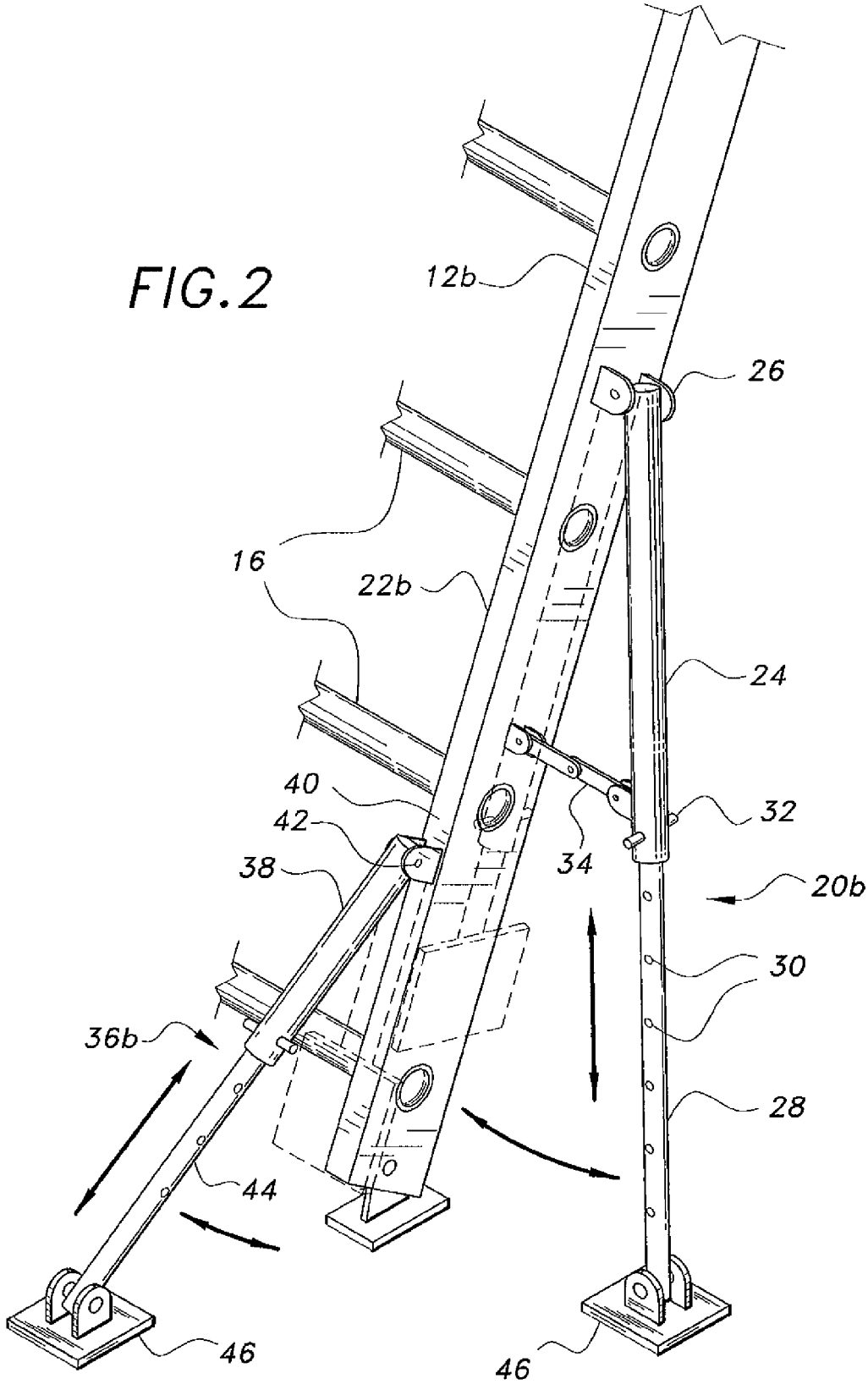
FIG. 2 is a partial perspective view of the lower portion of the ladder of FIG. 1, illustrating details of a first embodiment of the lower lateral and front stabilizer legs of the ladder.

FIG. 2 provides a detailed perspective view of two of the lower stabilizer legs of the safety ladder 10. A first set of stabilizer legs, comprising first and second lateral stabilizer leg assemblies 20*a* and 20*b*, extends from the lower portion 22*a* and 22*b* of each of the lower rails 12*a* and 12*b*. Both lateral stabilizer leg assemblies 20*a*, 20*b* and the lower end portions 22*a*, 22*b* of the two lower rails 12*a*, 12*b* are illustrated in FIG. 1. Each lateral stabilizer leg assembly includes an attachment section, e.g., section 24 of the second lateral stabilizer leg assembly 20*b* in FIG. 2, which is pivotally attached to the lower section or end portion 22*a*, 22*b* of its respective rail by a hinge or pivot attachment 26. A distal section, e.g., section 28 of the second lateral stabilizer assembly 20*b*, telescopically extends from the attachment section 24. Some means of selectively locking the extension of the second section 28 relative to the first section 24 is preferably provided, e.g., a plurality of transverse holes 30 through the lower section and a diametric pin 32 selectively disposed through a single lateral passage in the first or attachment section 24 a selected pair of the aligned holes 30 of the second section 28. A folding brace or stay 34 connects the attachment section 24 of each lateral leg assembly to its respective rail, e.g., the attachment section 24 and second rail 12*b* shown in FIG. 2. The axis of the pivot attachment 26 and the orientation of the stay 34 restrict the arcuate movement of the lateral stabilizer leg assemblies 20*a*, 20*b* to the plane of the lower ladder.

Additional first and second forward stabilizer leg assemblies 36*a* and 36*b* may be provided on the lower end portions or sections 22*a* and 22*b* of the two lower rails 12*a* and 12*b*. FIG. 2 provides a detailed view of the second forward stabilizer leg assembly 36*b*. The two forward stabilizer leg assemblies 36*a*, 36*b* are configured similar to the two lateral stabilizer assemblies 20*a* and 20*b*, i.e., having an attachment section, e.g., section 38 of the second forward stabilizer leg assembly 36*b* in FIG. 2, which is pivotally attached to the forward flange 40 or other suitable portion of the lower section or end portion 22*a*, 22*b* of its respective rail by a hinge or pivot attachment 42. A distal section, e.g., section 44 of the second forward stabilizer assembly 36*b*, telescopically extends from the attachment section 38. The mutually telescoping attachment section 38 and distal section 44 include some means of locking their extended length, e.g., a mechanism similar to that provided for the two lateral stabilizer leg assemblies discussed further above. As the pivot attachment 42 extends from the forward flange 40 of the lower portion 22*b* of the rail 12*b*, it will be seen that the forward stabilizer leg assembly 36*b* extends through an arc orthogonal to the plane of the lower ladder, i.e., outwardly from its rail 12*b* and opposite to the face of the ladder 10 that would face the structure supporting the ladder when it is erected. The corresponding forward stabilizer leg assembly 36*a* pivots through a plane parallel to that of the second stabilizer leg assembly 36*b*. These two forward stabilizer leg assemblies 36*a*, 36*b* thus extend outwardly away from the ladder supporting structure to prevent the ladder 10 from toppling backward away from the supporting structure if the ladder is erected at a slope close to vertical.

Figure 3:
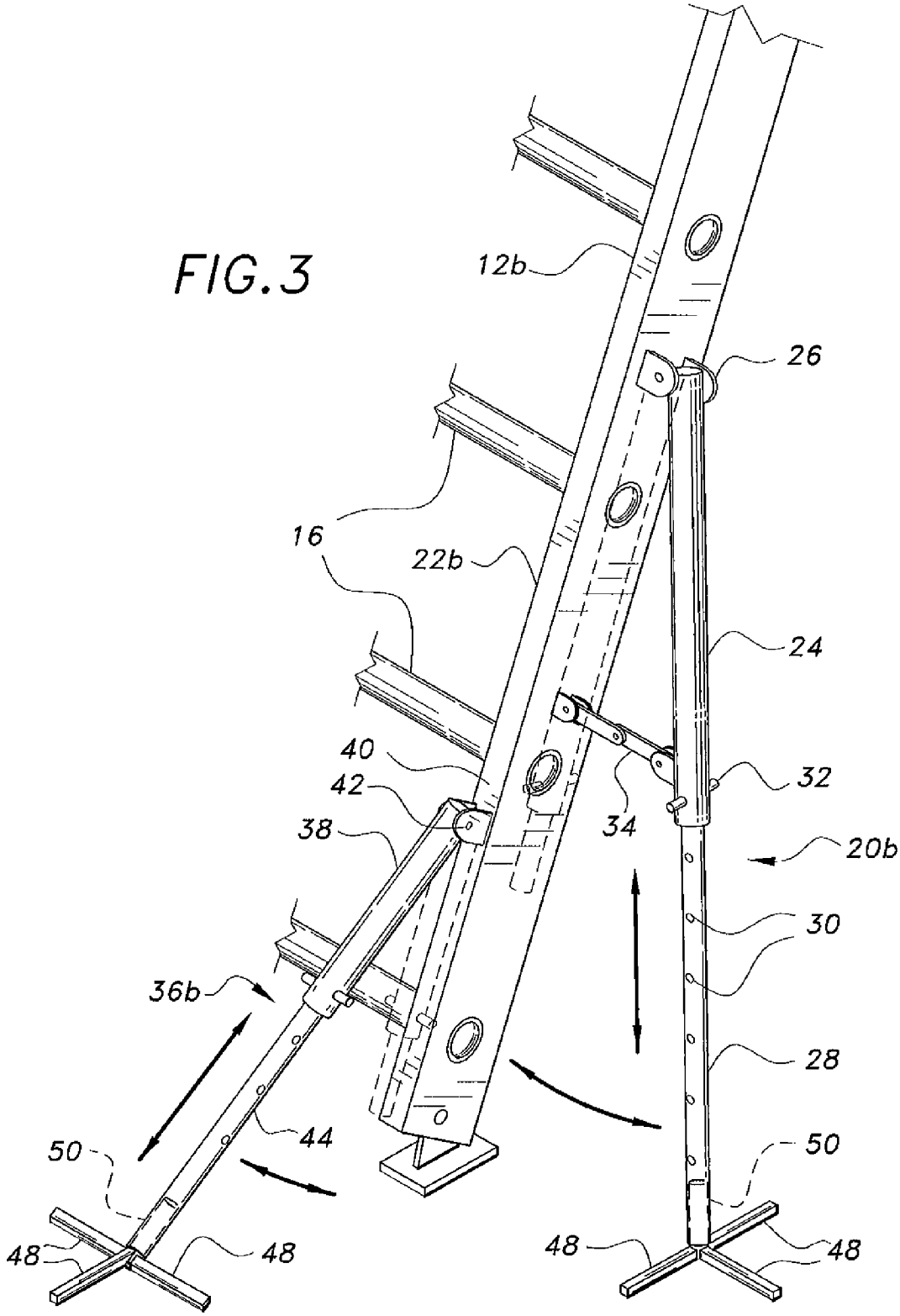
FIG. 3 is a partial perspective view of the lower portion of a safety ladder according to the present invention, illustrating details of a second embodiment of the lower lateral and front stabilizer legs of the ladder.

An articulating rest of some sort is provided at the distal end of each of the stabilizer leg assemblies 20*a*, 20*b*, 36*a*, and 36*b* to distribute the loads imparted thereby. In FIG. 2, the distal end of each of the stabilizer leg assemblies includes a relatively wide pad 46 pivotally attached thereto. FIG. 3 illustrates an alternative means, comprising a plurality of radially disposed elongate members 48 selectively extending from the distal ends of the distal sections 28 and 44 of the stabilizer leg assemblies. Each of the members 48 is pivotally attached to a central component 50 that is, in turn, concentrically installed in the distal end of each of the distal sections 28 and 44. The central component 50 telescopes inwardly and outwardly from its respective distal section, drawing the elongate members 48 into the respective distal section when retracted and allowing the elongate members 48 to spread as shown in FIG. 3 when extended. Conventional springs (not shown) may be used to bias the members 48 outwardly and to urge the central component 50 to its retractile state within the distal end of the distal section of the corresponding leg assembly.

Figure 4:
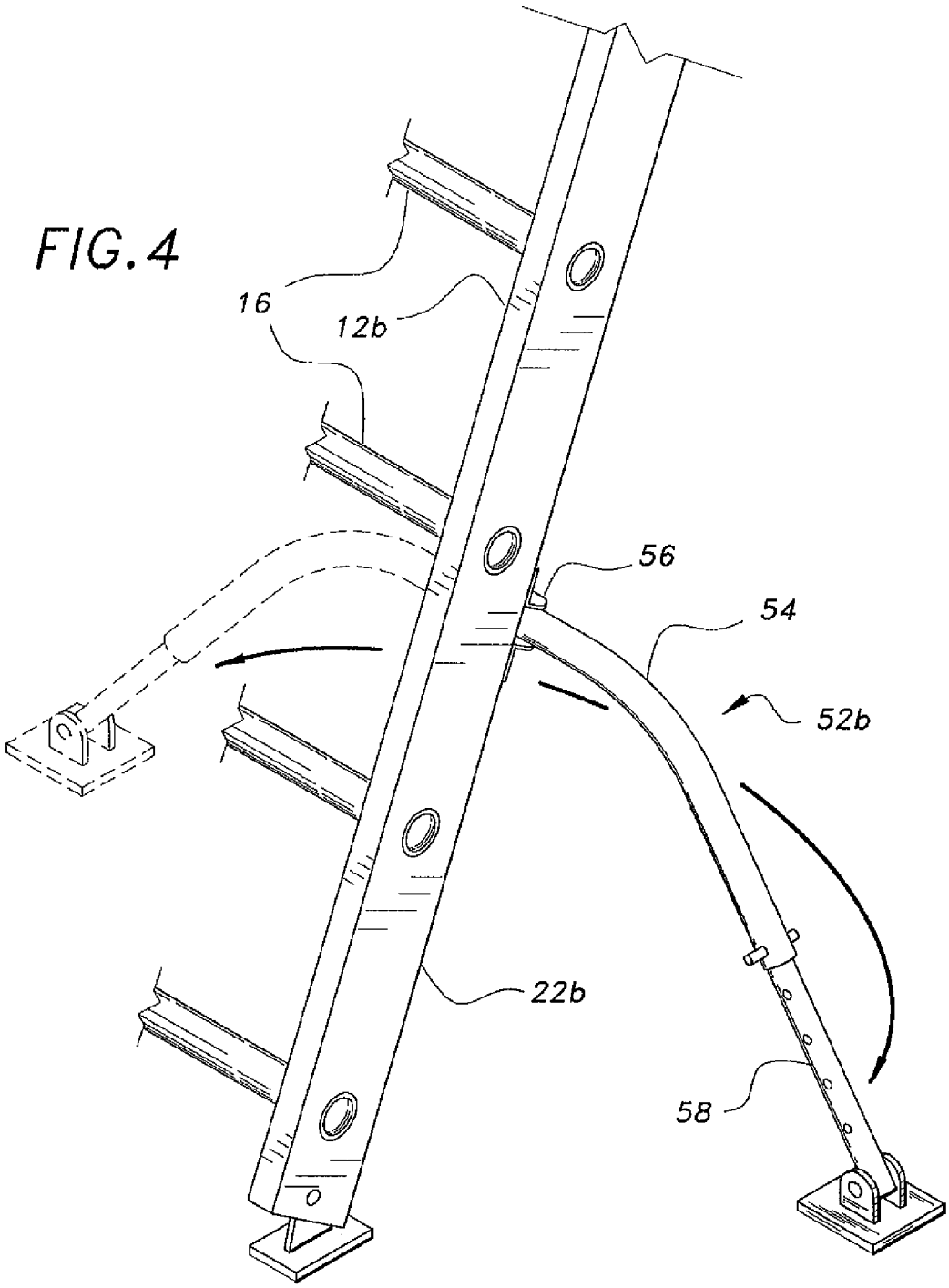
FIG. 4 is a partial perspective view of the lower portion of a safety ladder according to the present invention, illustrating details of a third embodiment of the lower lateral stabilizer legs of the ladder.

FIG. 4 provides a detailed perspective view of the lower portion 22*b* of the second lower rail 12*b* that incorporates a different type of lateral stabilizer leg assembly. The lateral stabilizer leg assembly 52*b* of FIG. 4 comprises a curved upper or attachment section 54, which is pivotally attached to the back of the lower portion 22*b* of the lower rail 12*b* by an appropriate pivot bracket or attachment 56. The upper or attachment section 54 curves downwardly from its attachment point and has a straight lower portion. A straight distal section 58 selectively extends and retracts telescopically from the straight lower portion of the upper or attachment section 54, its length being locked by means of a suitable mechanism, e.g., the pin and transverse holes used with the lateral and forward stabilizer leg assemblies 20*a*, 20*b*, 36*a*, and 36*b*. This configuration allows the stabilizer leg assembly 52*b* (and its counterpart for the opposite side of the ladder) to swing or pivot about an axis parallel to the elongate axis of its rail, thereby allowing the leg assembly 52*b* to pivot behind the ladder for storage, as shown in broken lines in FIG. 4.

Figure 5:
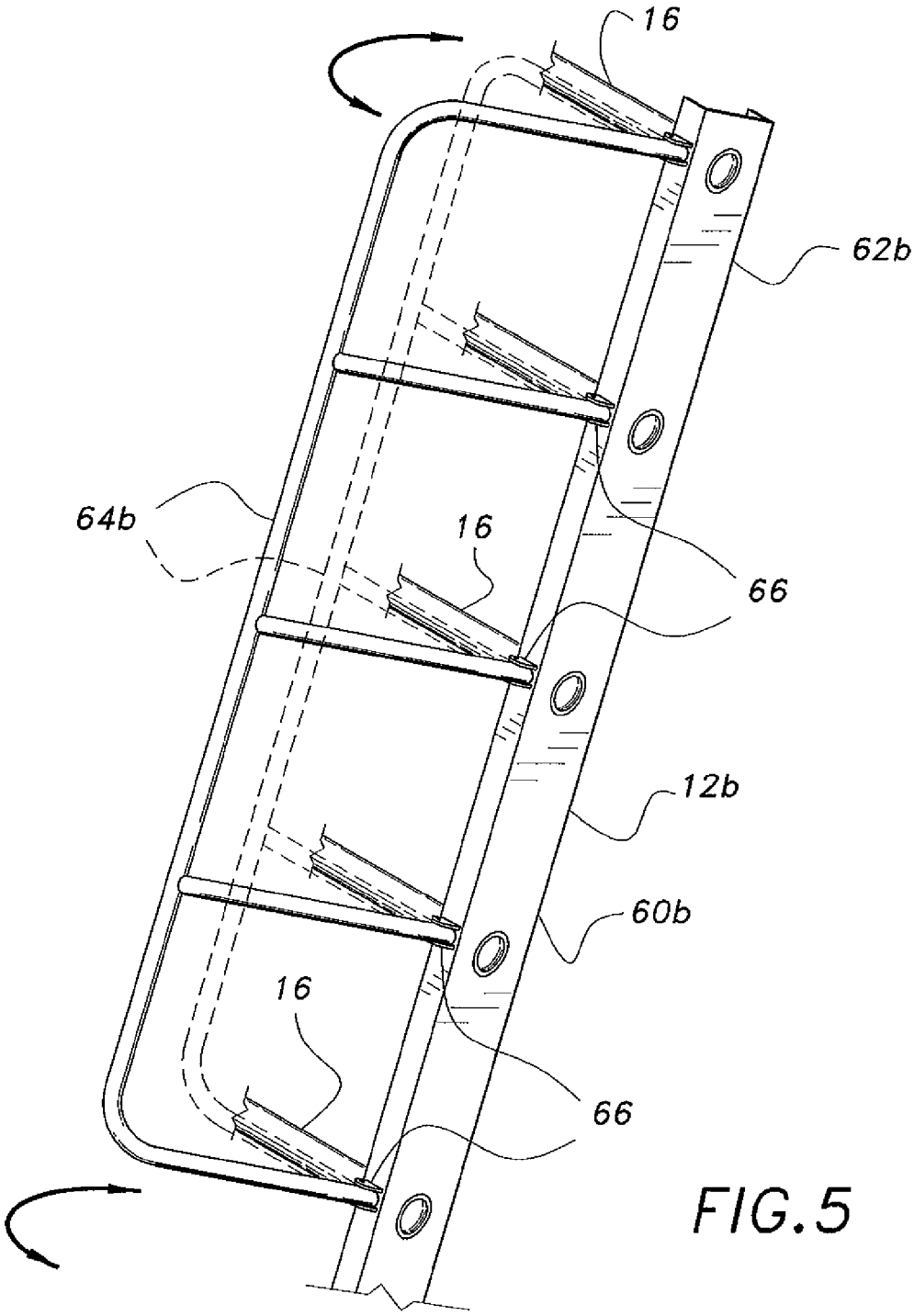
FIG. 5 is a partial perspective view of the ladder of FIG. 1, illustrating details of the folding handrail.

Additional safety features are provided farther up the ladder 10. FIG. 5 provides an illustration of the medial portion 60*b* and upper portion 62*b* of the second or right side lower rail 12*b*. A folding guardrail 64*b* extends from the medial portion 60*b* upward to or toward the upper end portion 62*b* of the second lower rail 12*b*, and a corresponding folding guardrail 64*a* extends from the first lower rail 12*a*, as shown in FIG. 1. Each of the guardrails 64*a*, 64*b* is attached to its corresponding lower rail 12*a*, 12*b* by a series of pivotal attachments 66, much like the attachments 26 and 32 securing the lateral and forward stabilizer leg assemblies 20*a*, 20*b*, 36*a*, and 36*b* to the ladder structure. The guardrails 64*a*, 64*b* may be deployed when the ladder 10 is erected, and may be folded closely against the rungs 16 of the ladder for storage, as shown by the broken line position of the second guardrail 64*b* in FIG. 5.

Figure 6:
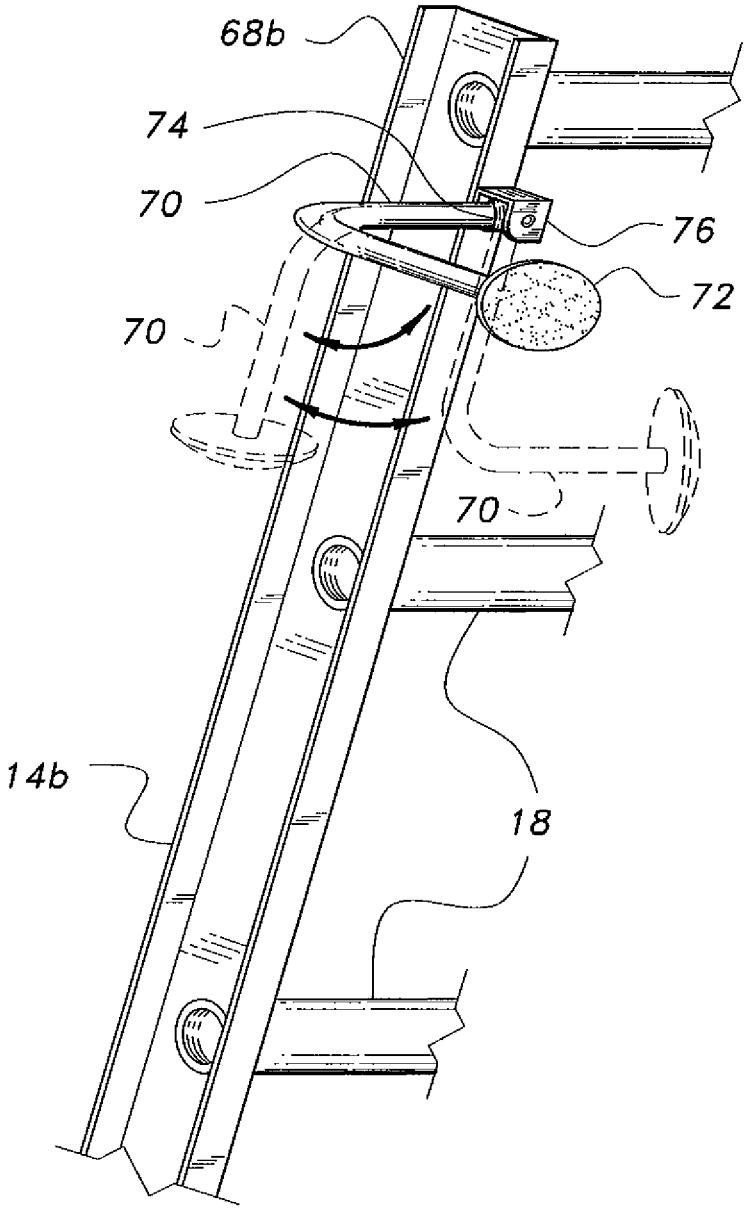
FIG. 6 is a partial perspective view of the upper portion of a safety ladder according to the present invention, illustrating details of one of the upper lateral stabilizer arms and its folding articulation.

FIG. 6 is a partial perspective view of the upper end portion 68*b* of the second upper rail 14*b*, illustrating an articulating standoff arm 70 that may be incorporated with the safety ladder 10. Two of the standoffs 70 are also shown deployed in the environmental view of FIG. 1. The standoffs 70 are deployed from the ladder 10 to serve as braces to prevent the ladder 10 from contacting the structure against which the ladder is placed, e.g., the side or other structure of a house or similar building, thereby preventing the ladder 10 from marring or otherwise damaging the building structure. The distal ends of the standoff arms 70 are provided with pads 72, cushions, or the like to provide further protection for the structure. Each standoff arm 70 has a base that is rotationally installed in a socket 74 that is, in turn, pivotally attached to the upper rail 14*a*, 14*b* (14*b* shown in FIG. 6) by a pivot bracket or attachment 76, similar to those pivotal attachments 26, 42, and 56 used for the attachment of the various lateral and forward stabilizer leg assemblies discussed further above. The base portion of the arm of each of the standoffs 70 may rotate coaxially within its respective socket 74, the socket 74, in turn, pivoting within its bracket or attachment 76 to allow the standoff 70 to be folded, as shown in broken lines in FIG. 6.

Figure 7:
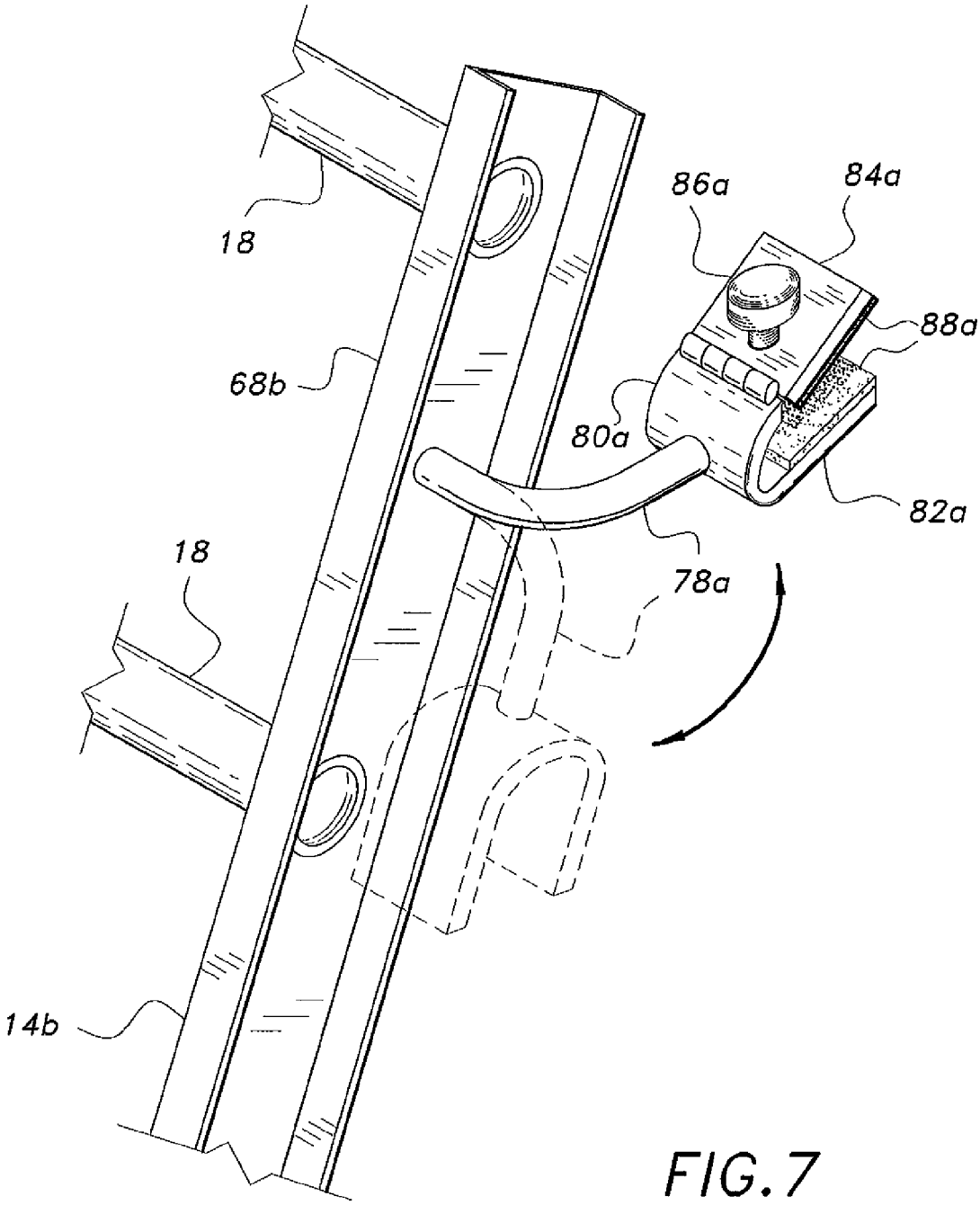
FIG. 7 is a partial perspective view of the upper portion of a safety ladder according to the present invention, illustrating a first embodiment of an upper security clamp.

Safety is further enhanced by one or more upper end structure attachments provided at the upper end portion of the ladder 10. FIG. 7 illustrates a first embodiment of such a structure attachment 78*a*. The structure attachment 78*a* of FIG. 7 includes a bent arm, similar to the arm of the standoff 70 of FIG. 6. The arm of each structure attachment is pivotally attached to the upper end portion 68*b* of the ladder, e.g., the upper rails 14*a* and 14*b*. A pivot bracket or attachment may also be provided as in the bracket 76 of the standoff 70 of FIG. 6, but the relatively short lateral span of the structure attachment 78*a* provides compact storage for the attachment 78*a* when pivoted down to lie in the plane of the ladder. The distal end of the structure attachment 78*a* includes a generally U-shaped base 80*a* having a fixed flat plate 82*a* extending from one end of the U-shaped base 80*a* and a hinged flat plate 84*a* extending from the opposite end thereof. The two plates 82*a* and 84*a* form extensions of the U-shaped base 82*a*. A clamping screw 86*a* passes through the hinged plate 84*a* and engages the fixed plate 82*a* to tighten the two plates 82*a*, 84*a* to a structure, e.g., the eaves E, as shown generally in FIG. 1. The mutually facing interior surfaces of each plate 82*a*, 84*a* may be provided with padding 88*a*, cushioning, or the like to preclude marring the surface to which they are attached.

Figure 8:
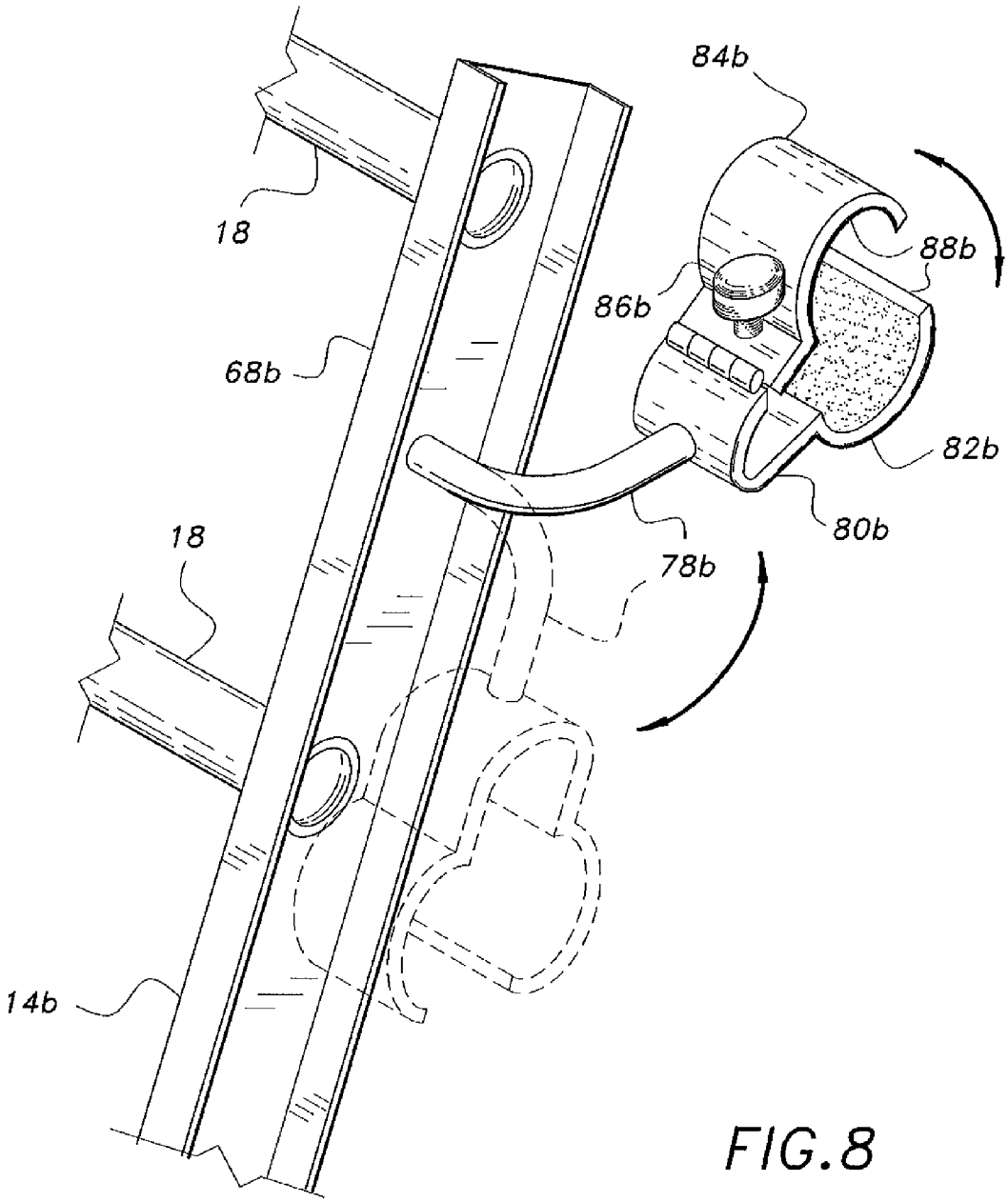
FIG. 8 is a partial perspective view of the upper portion of a safety ladder according to the present invention, illustrating a second embodiment of an upper security clamp.

FIG. 8 illustrates a second embodiment of such a structure attachment, designated as attachment 78*b*. The structure attachment 78*b* of FIG. 8 includes a bent arm, similar to the arm of the standoff 70 of FIG. 6 and the arm of the structure attachment 78*a* of FIG. 7. The arm of each structure attachment is pivotally attached to the upper end portion 68*b* of the ladder, e.g., the upper rails 14*a* and 14*b*. A pivot bracket or attachment may also be provided as described above for the structure attachment 78*a* of FIG. 7. The distal end of the structure attachment 78*b* includes a generally U-shaped base 80*b* having a fixed semicircular plate 82*b* extending from one end of the U-shaped base 80*b* and a hinged semicircular plate 84*b* extending from the opposite end thereof, the two plates 82*b*, 84*b* forming a generally circular closure when tightened together. The two semicircular plates 82*b* and 84*b* form extensions of the U-shaped base 82*b*. A clamping screw 86*b* passes through the hinged plate 84*b* and engages the fixed plate 82*b* to tighten the two plates 82*b*, 84*b* to a structure having a generally circular cross section, e.g., a pipe, tree branch, etc. The mutually facing interior surfaces of each plate 82*b*, 84*b* may be provided with padding 88*b*, cushioning, or the like to preclude marring the surface to which they are attached.

Figure 9:
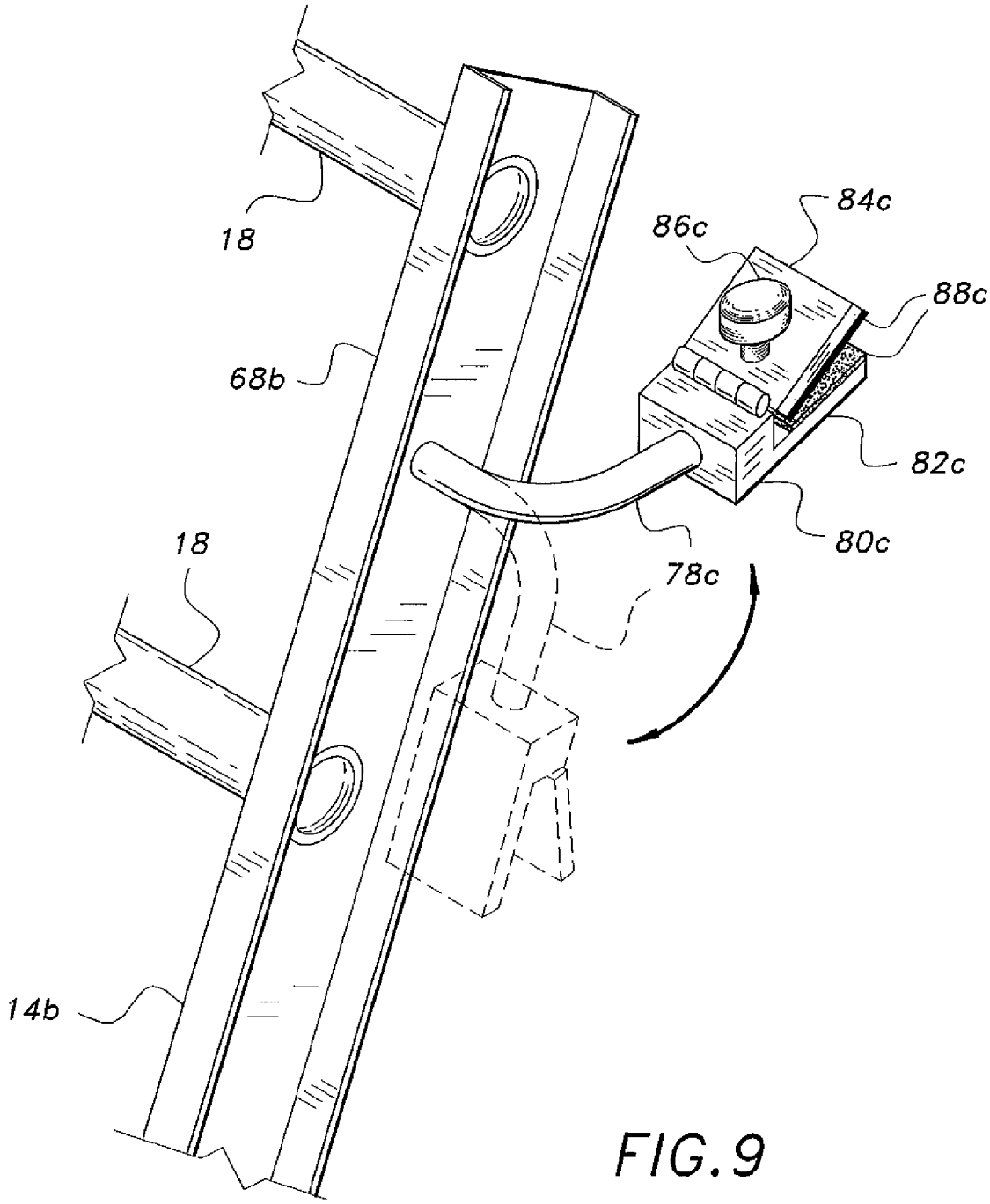
FIG. 9 is a partial perspective view of the upper portion of a safety ladder according to the present invention, illustrating a third embodiment of an upper security clamp.

FIG. 9 illustrates a third embodiment of such a structure attachment, designated as attachment 78*c*. The structure attachment 78*c* of FIG. 9 includes a bent arm, similar to the arm of the standoff 70 of FIG. 6 and the arm of the structure attachments 78*a* and 78*b* respectively of FIGS. 7 and 8. The arm of each structure attachment is pivotally attached to the upper end portion 68*b* of the ladder, e.g., the upper rails 14*a* and 14*b*. A pivot bracket or attachment may also be provided as described above for the structure attachment 78*b* of FIG. 8. The distal end of the structure attachment 78*c* includes a flat base 80*c* having a fixed flat plate 82*c* extending from one edge of the base 80*c* and a hinged flat plate 84*c* extending from the opposite edge thereof, the two plates 82*c*, 84*c* closing upon one another when tightened together. The two plates 82*c* and 84*c* form extensions of the base 80*c*. A clamping screw 86*c* passes through the hinged plate 84*c* and engages the fixed plate 82*c* to tighten the two plates 82*c*, 84*c* to a thin structure. The mutually facing interior surfaces of each plate 82*c*, 84*c* may be provided with padding 88*c*, cushioning, or the like to preclude marring the surface to which they are attached.

Figure 10:
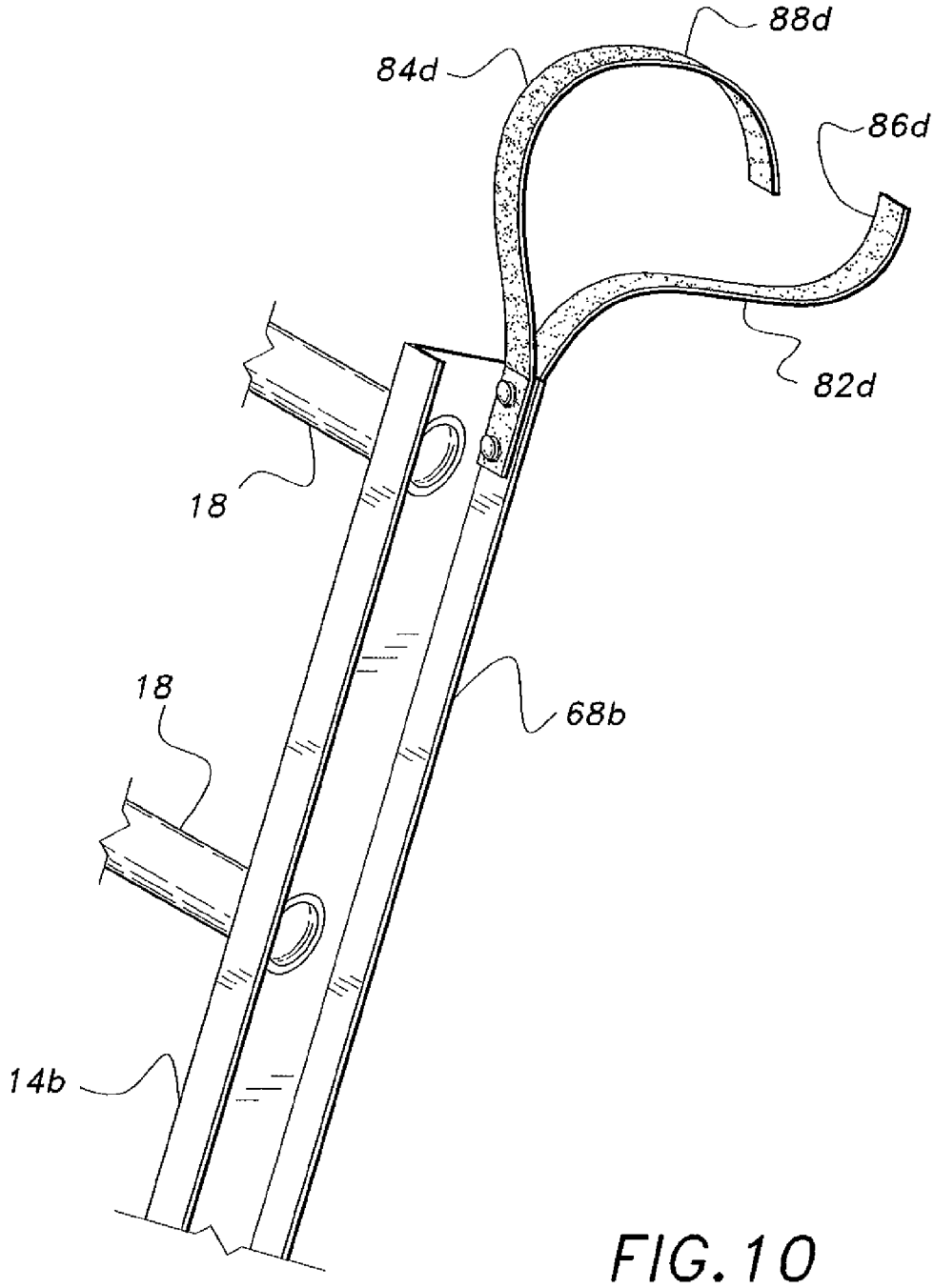
FIG. 10 is a partial perspective view of the upper portion of a safety ladder according to the present invention, illustrating an upper security strap.

FIG. 10 illustrates yet another embodiment of a ladder upper end attachment for the safety ladder 10. The embodiment of FIG. 10 comprises mutually opposed first and second flexible straps 82*d* and 84*d* attached to the upper end of each upper rail, as shown for the second upper rail 14*b* in FIG. 10. The two straps 82*d*, 84*d* have facing, mating attachment portions or surfaces thereon, e.g., first and second mating hook and loop fastener material 86*d* and 88*d*. The straps 82*d*, 84*d* may be wrapped around a structure, e.g., tree branch, pipe, etc., to secure the upper end of the ladder 10 safely thereto.

Figure 11:
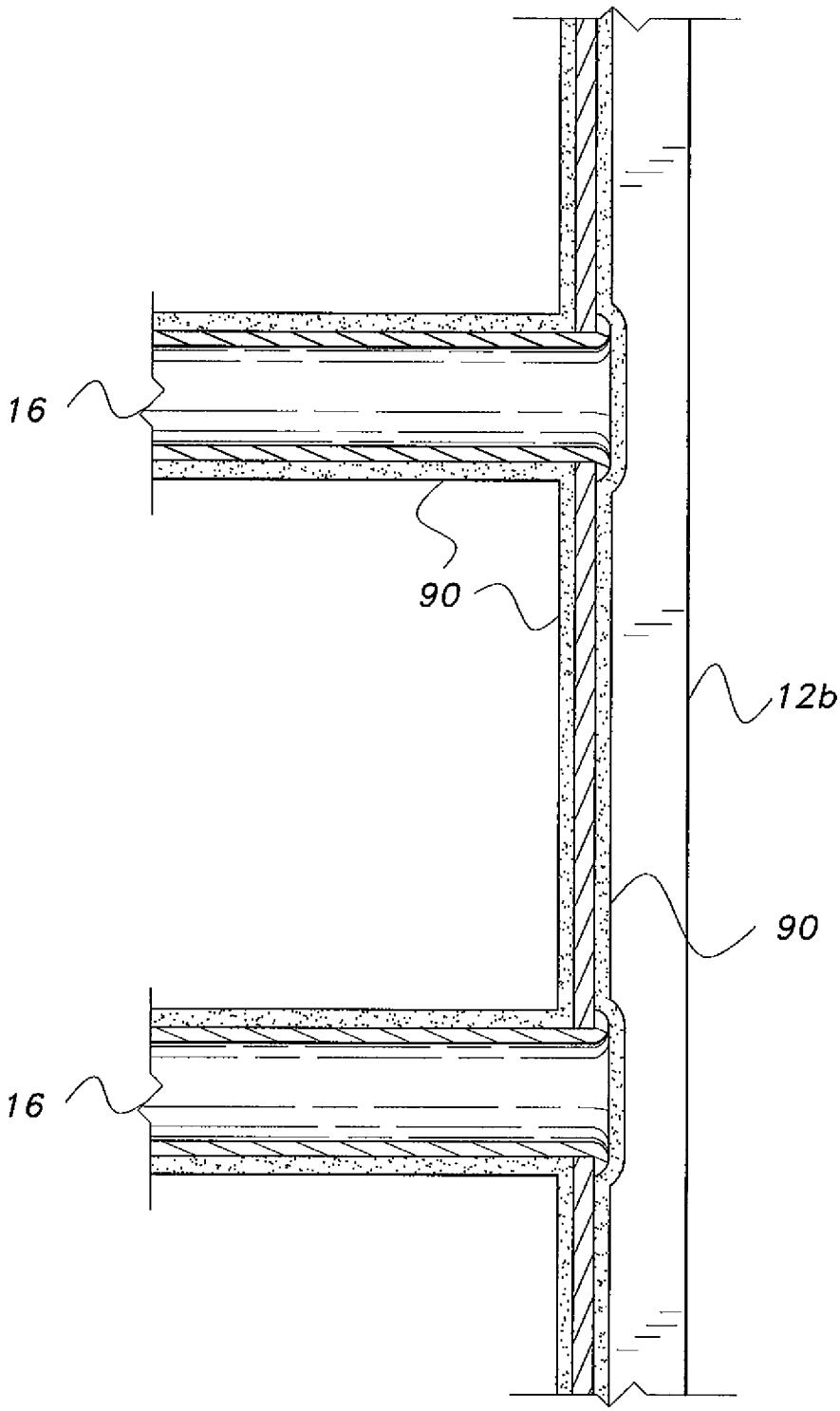
FIG. 11 is a partial elevation view in section through a portion of the right side of a safety ladder according to the present invention, illustrating the electrically insulating coating of the ladder structure.

While the safety ladder 10 may be constructed of any number of practicable materials, it is envisioned that a common material for its construction will be aluminum. As aluminum is highly electrically conductive, it is important that the safety ladder 10 be electrically insulated to prevent electrical shock to a user of the ladder should the ladder 10 inadvertently come into contact with a live electrical source. FIG. 11 provides a cross sectional view of a portion of the safety ladder 10 illustrating the metal structure of one of the rails and its rungs, e.g., the second lower rail 12*b* and its rungs 16. The rail 12*b* and rungs 16 will be seen to be coated or covered with an electrically non-conductive material, e.g., natural or synthetic rubber, plastic, etc. Thus, the combination of safety features comprising lower lateral and forward leg assemblies, guardrails, upper standoffs and structure attachments, and electrically non-conductive coating provide a considerable improvement in ladder safety.

It is to be understood that the present invention is not limited to the embodiments described above, but encompasses any and all embodiments within the scope of the following claims.

We claim:

1. A safety ladder, comprising:

at least one first rail having a front, a rear, a lower end portion, an upper end portion opposite the lower end portion, and a medial portion;

at least one second rail having a front, a rear, a lower end portion, an upper end portion opposite the lower end portion, and a medial portion, the second rail being spaced apart from and parallel to the first rail, the rear of each of the at least one first rail and the at least one second rail being adapted for facing a surface upon which the safety ladder leans;

a plurality of spaced apart rungs connecting the first rail and the second rail to one another, the rungs, the first rail, and the second rail defining a ladder plane;

a first lower lateral stabilizer leg selectively extending from the first end portion of the first rail, parallel to the ladder plane, wherein the first lower lateral stabilizer leg is directly pivotally secured to the side of the first rail;

a second lower lateral stabilizer leg selectively extending from the first end portion of the second rail, parallel to the ladder plane, wherein the second lower lateral stabilizer leg is directly pivotally secured to the side of the second rail;

a first forward stabilizer leg selectively extending forwardly from, and being directly pivotally secured to, the front of the first end portion of the first rail, orthogonal to the ladder plane, said first forward stabilizer leg being rotatable in, and limited in rotation in, a forwardly extending plane orthogonal to the ladder plane, wherein said first forward stabilizer leg is collapsible against the front of the first end portion of the first rail; and a second forward stabilizer leg selectively extending forwardly from, and being directly pivotally secured to, the front of the first end portion of the second rail, orthogonal to the ladder plane, said second forward stabilizer leg being rotatable in, and limited in rotation in, the forwardly extending plane orthogonal to the ladder plane, wherein said second forward stabilizer leg is collapsible against the front of the first end portion of the second rail, further comprising: a first folding guardrail selectively extending from the medial portion of the first rail, wherein the first folding guardrail is directly pivotally attached to the front of the first rail; and a second folding guardrail selectively extending from the medial portion of the second rail, wherein the second folding guardrail is directly pivotally attached to the front of the second rail.

2. The safety ladder according to claim 1, wherein:

each lower lateral stabilizer leg comprises an attachment section pivotally attached to the respective rail, and a distal section telescopically disposed within the attachment section and selectively extendible therefrom; and each forward stabilizer leg comprises an attachment section pivotally attached to the respective rail, and a distal section telescopically disposed within the attachment section and selectively extendible therefrom.

3. The safety ladder according to claim 2, wherein each lower lateral stabilizer leg and each forward stabilizer leg has a distal end, each of the distal ends having at least one articulating rest extending therefrom, each of the rests being selected from the group consisting of pivotally attached pads and a plurality of radially disposed, selectively retractable elongate members.

4. The safety ladder according to claim 1, further comprising:

a first articulating arm selectively extending from the upper end portion of the first rail;

a second articulating arm selectively extending from the upper end portion of the second rail;

a first upper end attachment selectively extending from the upper end portion of the first rail; and a second upper end attachment selectively extending from the upper end portion of the second rail.

5. The safety ladder according to claim 4, wherein:

each rail has an arm attachment bracket extending therefrom, each of the arm attachment brackets having an arm socket pivotally disposed therein;

each said articulating arm rotates concentrically within the corresponding arm socket, each of the arm sockets pivoting arcuately within the corresponding arm attachment bracket; and each said upper end attachment is selected from the group consisting of U-shaped clamps, clamps having a generally circular configuration, flat clamps, and flexible straps.

6. The safety ladder according to claim 1, wherein the at least one first rail and the at least one second rail each comprise at least two relatively slidably disposed rail sections defining an extension ladder.

7. A safety ladder, comprising:

at least one first rail having a front, a rear, a lower end portion, an upper end portion opposite the lower end portion, and a medial portion;

at least one second rail having a front, a rear, a lower end portion, an upper end portion opposite the lower end portion, and a medial portion, the second rail being spaced apart from and parallel to the first rail, the rear of each of the at least one first rail and the at least one second rail being adapted for facing a surface upon which the safety ladder leans;

a plurality of spaced apart rungs connecting the first rail and the second rail to one another, the rungs, the first rail, and the second rail defining a ladder plane;

a first articulating arm selectively extending from the upper end portion of the first rail;

a second articulating arm selectively extending from the upper end portion of the second rail;

a first upper end attachment selectively extending from the upper end portion of the first rail;

a second upper end attachment selectively extending from the upper end portion of the second rail;

a first lower lateral stabilizer leg selectively extending from the first end portion of the first rail, parallel to the ladder plane, wherein the first lower lateral stabilizer leg is directly pivotally secured to the side of the first rail;

a second lower lateral stabilizer leg selectively extending from the first end portion of the second rail, parallel to the ladder plane, wherein the second lower lateral stabilizer leg is directly pivotally secured to the side of the second rail;

a first forward stabilizer leg selectively extending forwardly from, and being directly pivotally secured to, the front of the first end portion of the first rail, orthogonal to the ladder plane, said first forward stabilizer leg being rotatable in, and limited in rotation in, a forwardly extending plane orthogonal to the ladder plane, wherein said first forward stabilizer leg is collapsible against the front of the first end portion of the first rail; and a second forward stabilizer leg selectively extending forwardly from, and being directly pivotally secured to, the front of the first end portion of the second rail, orthogonal to the ladder plane, said second forward stabilizer leg being rotatable in, and limited in rotation in, the forwardly extending plane orthogonal to the ladder plane, wherein said second forward stabilizer leg is collapsible against the front of the first end portion of the second rail, further comprising: a first folding guardrail selectively extending from the medial portion of the first rail, wherein the first folding guardrail is directly pivotally attached to the front of the first rail; and a second folding guardrail selectively extending from the medial portion of the second rail, wherein the second folding guardrail is directly pivotally attached to the front of the second rail.

8. The safety ladder according to claim 7, wherein:

each rail has an arm attachment bracket extending therefrom, each of the arm attachment brackets having an arm socket pivotally disposed therein;

each said articulating arm rotates concentrically within the corresponding arm socket, each of the arm sockets pivoting arcuately within the corresponding arm attachment bracket; and each said upper end attachment is selected from the group consisting of U-shaped clamps, clamps having a generally circular configuration, flat clamps, and flexible straps.

9. The safety ladder according to claim 7, wherein:

each lower lateral stabilizer leg comprises an attachment section pivotally attached to the respective rail, and a distal section telescopically disposed within the attachment section and selectively extendible therefrom; and each forward stabilizer leg comprises an attachment section pivotally attached to the respective rail, and a distal section telescopically disposed within the attachment section and selectively extendible therefrom.

10. The safety ladder according to claim 9, wherein:

each lower lateral stabilizer leg and each forward stabilizer leg has a distal end, each of the distal ends having at least one articulating rest extending therefrom; and each of the rests is selected from the group consisting of pivotally attached pads and a plurality of radially disposed, selectively retractable elongate members.

11. The safety ladder according to claim 7, wherein the at least one first rail and the at least one second rail each comprise at least two relatively slidably disposed rail sections defining an extension ladder.

* * * * *